US006453633B1

(12) United States Patent
Wilkinson, Jr. et al.

(10) Patent No.: US 6,453,633 B1
(45) Date of Patent: Sep. 24, 2002

(54) OVERHEAD PANEL INSTALLATIONS

(75) Inventors: E. Lee Wilkinson, Jr., Cincinnati, OH (US); Edgar L. Wilkinson, Cincinnati, OH (US)

(73) Assignee: EPS Specialties Ltd., Inc., Cincinnati, OH (US)

( * ) Notice: Subject to any disclaimer, the term of this patent is extended or adjusted under 35 U.S.C. 154(b) by 0 days.

(21) Appl. No.: 09/963,814

(22) Filed: Sep. 26, 2001

(51) Int. Cl.[7] ..... E04B 1/38

(52) U.S. Cl. ..... 52/506.06; 52/787.1; 52/787.11; 52/506.08; 52/506.05; 52/302.1; 40/617; 40/631; 40/601

(58) Field of Search ..... 52/506.06, 787.1, 52/787.11; 40/617, 601, 631

(56) References Cited

U.S. PATENT DOCUMENTS 2,376,279 A * 5/1945 Schlenkert ..... 206/343
3,426,489 A * 2/1969 Lambert ..... 52/39
5,898,987 A * 5/1999 Onofrio ..... 29/446
5,946,875 A * 9/1999 Jeanseau ..... 248/323
6,215,881 B1 * 4/2001 Azima et al. ..... 181/167

* cited by examiner

*Primary Examiner*—Carl D. Friedman
*Assistant Examiner*—Basil Katcheves
(74) *Attorney, Agent, or Firm*—Edmund S. Lee, III

(57) ABSTRACT

Light weight, foamed panels are suspended in spaced relation above the floor of an arena to create "privacy zones" which facilitate discussion and concentration on details. In the prior art, attachment of the panels to mounting rods was predicated on cementing wooden strips in the upper surface of the panel, in order to provide T-nuts, into which suspension rods are threaded. The improved installation employs a plurality of attaching members, each of which has a tubular body portion which is inserted through a vertically disposed hole in the foamed panel and an ornamental flange projecting laterally and underlying the bottom of the penal. Each tubular body portion has a threaded portion which is threaded onto a supporting rod. Torquing surfaces are provided on the attaching members to facilitate their being threaded onto the supporting rods.

4 Claims, 2 Drawing Sheets

OVERHEAD PANEL INSTALLATIONS

The present invention relates to improvements in the installation of overhead panels in order to create what are referred to a "privacy zones" in large exhibition halls, as well as in retail merchandising marts and other large scale arenas.

The buildings for such events and activities have become huge. They frequently have in excess of ten thousand square feet floor space in a given area, without interruption by walls or other lateral floor dividers. It is also customary that these display areas have a height of twenty feet or more, oftentimes extending uninterruptedly to the roof of the building. There are various reasons for the provision of these high, open areas, such as to accommodate large objects that are on display, or to provide readily accessible storage means. In any event, it has been found that it is difficult to transact business, to converse, or to concentrate on details in what can best be described as "cavernous" environment.

This has resulted in the practice of creating areas in which business and socializing can be had. This end has been attained by what is referenced as "privacy zones", that are created by overhead panels, which are positioned approximately at normal room height over areas of limited lateral extent, when compared to the vastness of a given exhibition hall. Such a privacy zone facilitates conversations with potential customers, the effective display of smaller items and the manual demonstration of the capabilities and characteristics of a particular item, as well as providing a manageable area for check out services, storage of supplies, etc.

There has developed a specialized trade devoted to the provision displays for exhibiting various and sundry items at trade shows, retail outlets, and the like. This specialized trade deals with creating an atmosphere which enhances and facilitates the communications requisite for positively influencing potential customers towards the acquisition of a particular product or service. Such displays are, desirably, light weight and resistant to abuse in order that they may be readily set up in a convention hall and then dissembled and shipped to another trade show in another arena. Even where a display is for a one time use, the need for light weight components and ease of set up is still a prime consideration and economy of construction can be of even greater importance.

In the particular aspect of providing an overhead panel for a selected area of an exhibition hall, or the like, it has become an accepted practice to employ cellular, resinous panels that are highly effective in meeting the light weight requirement. Expanded, foamed polystyrene has been found particularly economical for such purposes. The surface of the expanded polystyrene material is extremely soft so that it is a usual practice to provide an outer surface laminate, or skin, which provides a measure of durability, gives a visual attractiveness as well as providing ignition retardant characteristics that may be mandated by building or fire codes. A typical overhead panel will have a thickness sufficient to give it sufficient strength in being handled as well as for it to be rigid and hold its desired shape, when positioned for display purposes, and usually is capable of being manually carried and positioned for installation.

An accepted practice in creating privacy zones is to secure the upper ends of rods to overlying girders, or other structural members of an exhibition hall. These rods then depend to a point spaced above the convention hall floor, with the overhead panel being attached thereto. The expanded polystyrene core for such panels does not have sufficient strength for these rods to be directly threaded therein. The attaching means has therefore taken the form wooden strips on the upper surface of the overhead panel. Threaded tubes (T-nuts) are mounted on the wooden strips and threadably receive the depending mounting rods.

The object of the present invention is to provide an improved suspension system for overhead display panels and in so doing reduce the costs of the system as well as facilitating the installation of overhead display panels.

The foregoing ends may be attained by an overhead display panel installation in which the display panel is positioned in spaced relation above the floor of an exhibition hall, or other building of similar expanse, by a plurality of vertically disposed rods, supported by and depending from structural portions of the exhibition hall. The display panel is of substantial lateral extent, comprising a cellular core, which forms the greater part of its bulk, The display panel is attached to the lower ends of the rods by a plurality of attaching members respectively inserted into openings extending vertically through the display member and laterally spaced relative to each other and also spaced from the peripheral margin of the panel, Each attaching member preferably comprises a tubular body portion into which a lower end portion of a rod may extend, a threaded portion at the upper end of the tubular body portion, engaged with the rod extending therein, and an ornamental flange extending laterally outwardly from the tubular body portion, underlying an adjacent lower surface of the panel and providing support therefor, and torquing surfaces engageable to rotate the attaching member and thereby provide a vertical adjustment relative to the rod and thus establish a desired orientation of the display panel relative to the floor of the exhibition hall.

Additionally it is preferable to detachably mount the attaching members on the display panel in rotatable relation thereto. Preferably a washer is telescoped over an upper end portion of the an attaching member, which projects above an upper surface of the display panel. A snap ring engages the tubular portion of the attaching member immediately above the washer, to mount the attaching member on the panel. An additional feature is found in the tubular portion, the flange portion and the threaded portions thereof being separately formed components secured together to form a unitary attaching member.

IN THE DRAWINGS

Figure 1:
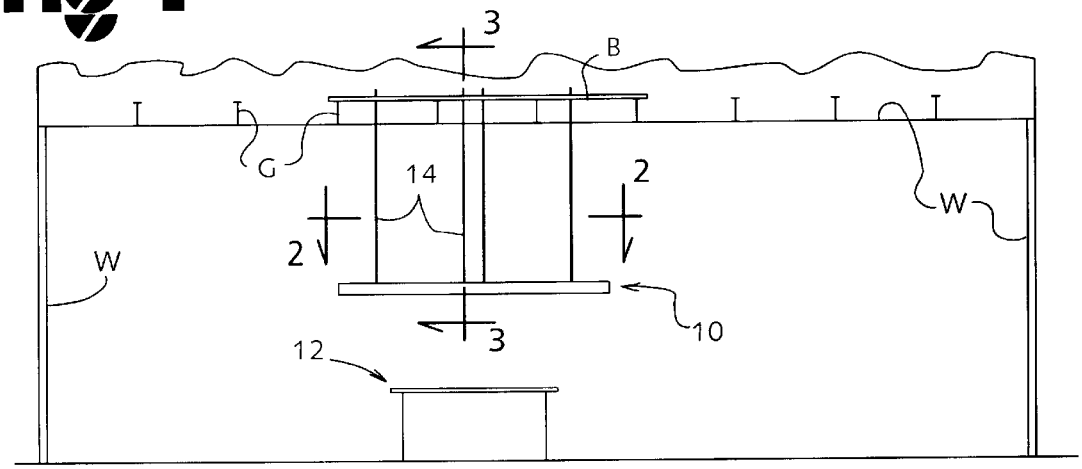
FIG. 1 is an elevation of an overhead display panel installation.
Figure 2:
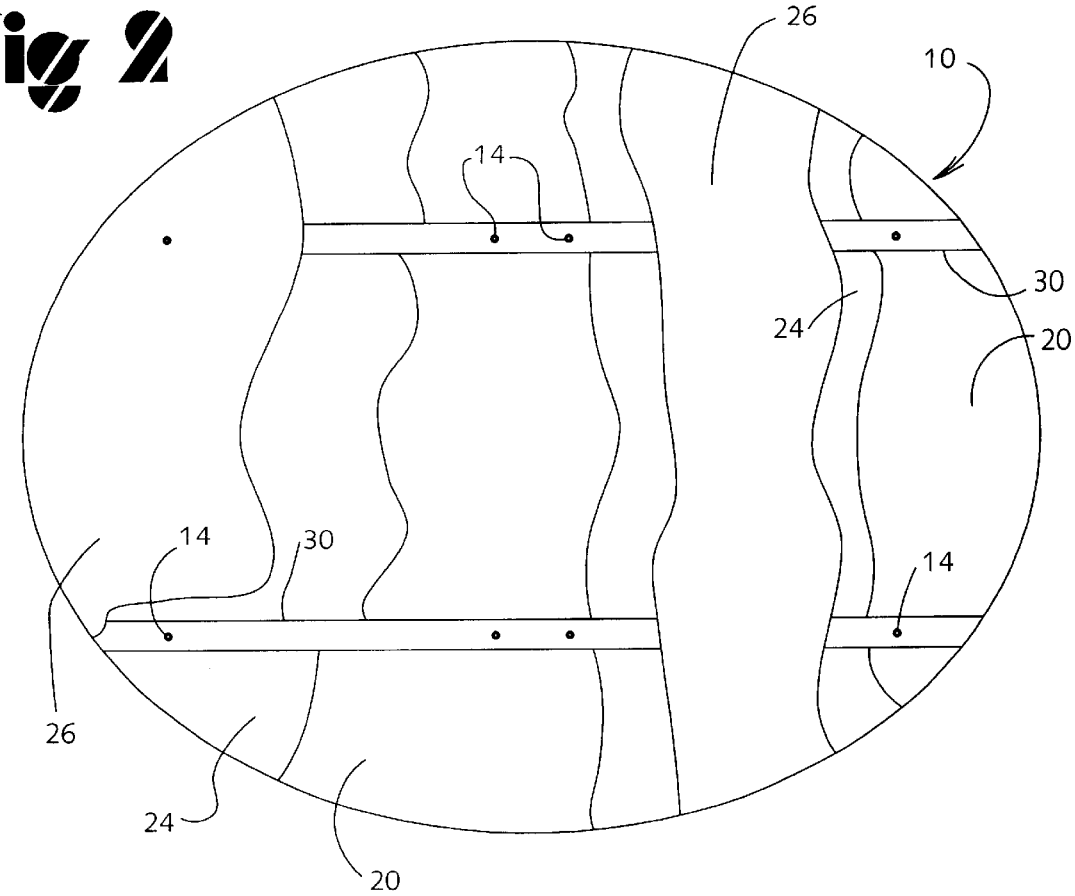
FIG. 2 is a section, on an enlarged scale and with portions broken away, taken on line 2—2 in FIG. 1, showing a plan view of the overhead display panel.
Figure 3:
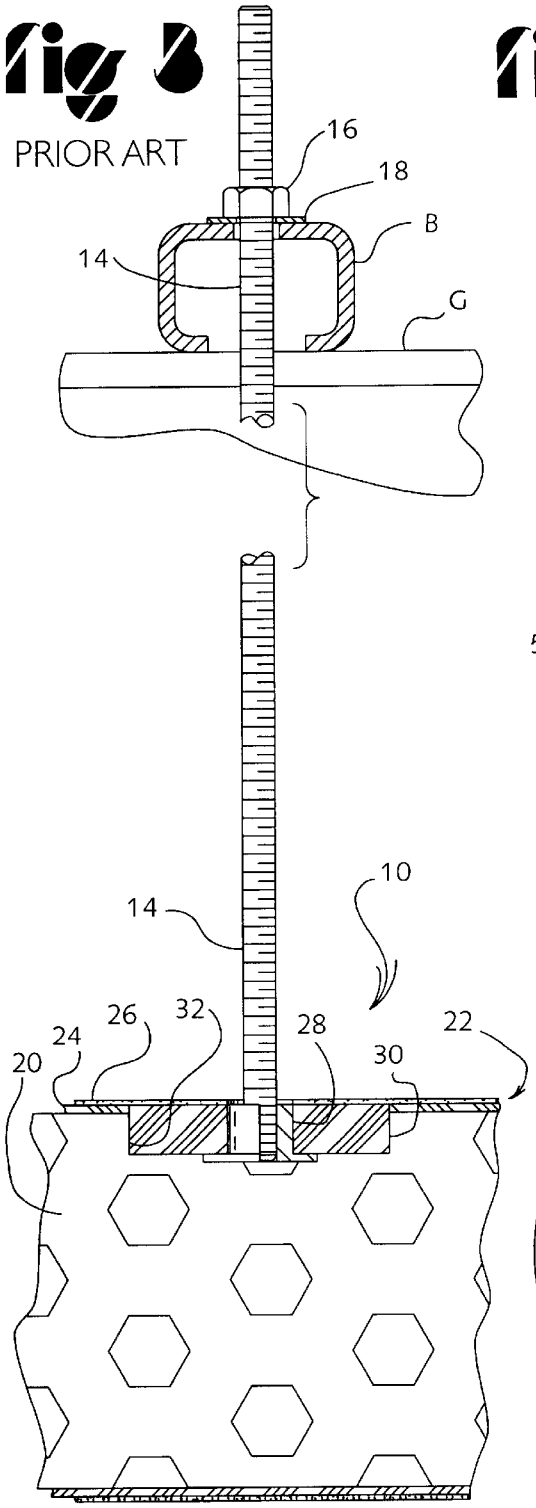
fig 3 PRIOR ART
FIG. 3 is section, on a further enlarged scale, taken on line 3—3 in FIG. 1 of the prior art connection between the display panel and one its supporting rods, longitudinally of the supporting rod.

FIG. 1 illustrates an overhead display panel installation as would be found in a conventional hall, retail merchandising outlet, or other enclosed arena, which is illustrated as being defined by walls W. A display panel 10 is shown in overlying relation to a booth 12 to provide a "privacy zone". This "privacy zone" establishes a manageable area, psychologically set apart from the expanse of the building's interior, for facilitating discussions between a salesperson and a potential customer, display of advertising, purchasing transactions, and other efforts to promote goods or services. The overhead panel 10 may be connected to eight threaded rods 14. The upper ends of the rods 14 may be supported from girders G (or any other load carrying structure of the building), which span the walls W at heights as much as, or more than, 20 feet above the floor level. Some degree of flexibility in the lateral positioning of the panel 10 is attained through the use of cross beams B, which span the girders G. The upper end portions of the rods extend through respective openings in the cross beam B (FIG. 3). A nut 16 is then threaded onto the upper end of each of the rods 14 to hold it in suspended relation from the girders G. A washer 18 is conventionally disposed between the each nut 18 and the respective cross bar B. A lock nut (not illustrated) or other conventional locking means can be employed to prevent unintentional rotation of the nut 16 relative to the rod 14 so that it will be maintained in a given heightwise position relative to its supporting structure and the underlying booth 12.

The present invention deals with improved means for attaching the display panel 10 to the rods 14 and will be best understood from the following description of a widely employed, prior art attaching means, having additional reference to FIG. 3.

The overhead panel 10 is compositely formed to provide the desired light weight characteristic and comprises an expanded polystyrene core 20 and an outer skin 22, which, in turn is compositely formed by a wood veneer 24, attached to the core 20 and an outer paper sheet 26, adhered to the veneer 24. The use of an outer skin on expanded polystyrene display panels is a common practice in order to prevent denting or other deformation of the extremely soft polystyrene material. The paper sheet 24 is optional and, when used, frequently provides a fire retardant function, pursuant to fire code requirements. The paper sheet may also be selected to provide a desired visual effect for the display panel, or to provide a surface that may be readily painted or it may be preprinted with advertising or other messages.

Further illustrative of the nature of the present invention is evidenced by the fact that the panel 10 is scaled to represent a length of 107 inches, a length of 136 inches and a thickness of 6 inches. With these dimensions and a density approximating one to three pounds per cubic foot, the panel car readily by supported by rods 14 having a ⅜ inch diameter.

Since the expanded foam core does not have the strength to permit the rods 14 to be threadably attached directly thereto metal, T-nuts 28 are mounted on the panel 10 to enable attachment of the panel 10 to the rods 14. More specifically, the T-nuts 28 are mounted on wooden strips 30 (usually formed of plywood). The strips 30 are set into grooves 32, formed in the core and secured therein by glue or other adhesive means.

With the T-nuts 28 thus provided, the lower ends of the rods 14 are threaded therein to mount the panel 10 in spaced relation above the booth 12. In the usual case a panel height of 7–10 feet above the floor has been found effective in providing the desired "privacy zone. In providing the removable mounting capability for the overhead panel, its weight and dimensions are basically unchanged so it can be readily transported and stored for use in other trade shows at different locations, or readily relocated when the physical layout of a retail store is had, or for whatever other reason that may arise.

One of the reasons that such overhead panels can be economically provided is in the use of expanded polystyrene and the fact that this material finds many and varied uses. It is therefore produced on a large scale basis. The low cost expanded polystyrene material is mass produced in rectangular sheets having a two foot by four foot cross sections and varying lengths up to 24 four feet or more. Typically, the expanded polystyrene will have a density approximately between one and three pounds per cubic foot, which gives a indication of the weight range of the display panels to which the present invention applies. It is also to be understood that when an oval outline, as illustrated by the panel 10, is desired. it would normally be cut from a rectangular sheet, rather than expanding the polystyrene material into a mold of the desired configuration, This is to point out that the expanded polystyrene material can be readily cut and "machined" by using ordinary woodworking tools.

Figure 4:
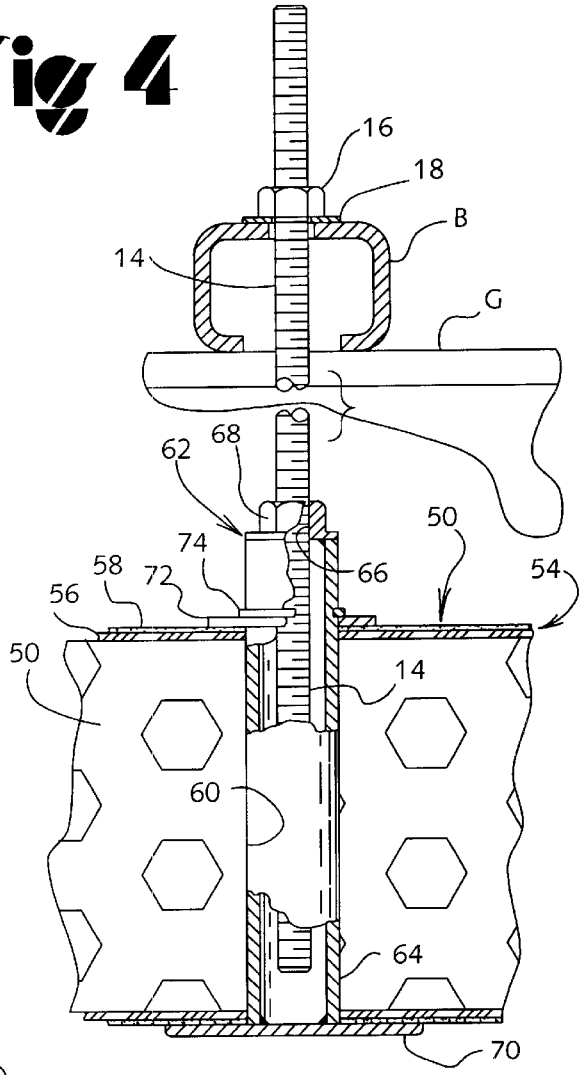
FIG. 4 is a section, on the same further enlarged scale, of a connection between a display and a supporting rod, embodying the present invention, also taken longitudinally of the supporting rod.
Figure 5:
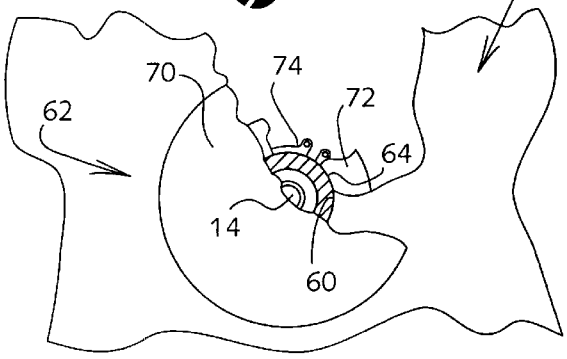
FIG. 5 is a bottom view, with portions broken away, of the connection seen in FIG. 4.

The improved overhead panel installation of the present invention will next be described with reference to FIGS. 4 and 5, which illustrates a fragmentary portion of an overhead panel 50, which may have the same oval configuration and thickness as the panel 10. Likewise the panel 50 may comprise a polystyrene core 52 and an outer skin 54 formed by a wood veneer 56 and a fire retardant paper sheet 58. The present invention is compatible with any expanded polystyrene panel (generically referenced as a cellular resinous panel) with or without a protective skin.

The panel installation of the present invention may employ the same rods 14 and the same means for securing the rods 14 to structural components of the convention hall or display arena, as previously described. The means for attaching the panel 50 to the rods 14, shown in FIGS. 4 and 5 are uniquely characterized by their simplicity. Holes 60 may be drilled in the display panel 50 in a pattern corresponding to the that of the supporting rods 14. Attachment members 62 are then inserted, respectively in the holes 60, for connection with each of the rods 14.

Each attachment member 62 may comprise a tubular body 64 having a threaded portion 66 at its upper end, which is engageable with the threads on the rods 14 and a torquing portion 68. A decorative flange 70 projects laterally outwardly from the lower end of the tubular body 64. The threaded portion 66 and the torquing portion 68 may be advantageously provided by welding, or otherwise securing, a threaded nut to the upper end of the tubular body 64. Similarly, the flange 70 may be a separate element welded, or otherwise secured to the tubular body 64.

The attachment members 62 provide a decorative option not previously available for overhead display panels. This is to point out the flanges 70 may be chrome plated to provide a highly reflected surface, may be embossed or otherwise be configured with surface ornamentations, or may be provided with a star shaped outline, or otherwise formed to provide a decorative effect, all of this in addition to providing the functional purpose of supporting the panel 10 from the rods 14.

It will also be noted that the described attaching members 62 facilitate the installation process in that most, if not all of the vertical adjustment of the attachment members relative to structural members (girders G) from which they are suspended may be made at the level of the display panel. This is to point out that having the threaded portion 66 at or extending above the upper surface of the panel 50, with the tubular portion 64 extending to the lower surface of the display panel 50, provides a range of adjustment approximating, or greater than the thickness of the display panel. By rotating the attaching members 62, the support loading on each attaching member 62 may be equalized as the panel is positioned at a desired height above the booth 12. The threaded nut portion 68 has a hexagonal outline which provides torquing surfaces for a wrench to facilitate rotation of the attaching members. In many cases, the members 62 can be adjusted by hand and any exposed surfaces might be engaged by a person's fingers for use as torquing surfaces.

A further feature of the present invention is found in the provision of means for rotatably mounting the attaching members 62 on the overhead panel 50. These means comprise a washer 72, which may be telescoped over the upper end of an attaching member, after it has been inserted through an opening 60. The washer 72 is held in assembled relation by a snap ring 74, mounted on the tubular portion 64 of the attaching member 62. The attaching members are thus detachably mounted on the display panel 50, being rotatable in the holes 50 and longitudinally restrained by the decorative flanges 70 and the washers 72. Being thus mounted, a workman has greater ease and facility in connecting the attaching members 62 to the mounting rods 14, in that it is not necessary to apply a manual force to maintain the attaching members in assembled relation on the panel, while connecting them to the rods 14. An additional advantage is that the attaching members 62 are maintained on and will not be lost or misplaced when the display panel is in storage or in transit to a new installation.

The prior art attaching means, described in connection with panel 10, are much more difficult to secure to the supporting rods 14. There is only a minimal extent of adjustment available between the rods and the attaching means (T-nuts 28). The result is that most adjustments of the panel height or to equalize the loading on the supporting rods 14, must be through a vertical repositioning of the rods 14. This requires threading the nuts 16 upwardly or downwardly on the rods 14, or other means by which the upper ends of the rods are secured to the structure of the building. This can be most inconvenient and time consuming in that such adjustment often must be made at heights of 20 feet or more. A prior art alternative for making such adjustments is the use of turnbuckles as a part of the connecting means. The latter approach still lacks the simplicity and convenience provided by the present invention.

Variations from the described embodiment, within the spirit and scope of the present inventive concepts, will occur to those skilled in the art. The limits of the invention are therefore found in the appended claims.

Having thus described the invention, what is claimed as novel and desired to be secured by Letters Patent of the United States is:

1. An overhead display panel installation in which a display panel of substantial lateral extent is positioned in spaced relation above the floor of an exhibition hall, or the like, said installation comprising a plurality of vertically disposed rods, supported from structural portions of said exhibition hall and depending therefrom, and means for attaching the display panel to the lower ends of said rods wherein the bulk of the display panel comprises a cellular core member, said attaching means being characterized by a plurality of attaching members respectively inserted into openings extending vertically through said display member and laterally spaced relative to each other and also spaced from the peripheral margin of said panel, said attaching members comprising a tubular body portion into which a lower end portion of a rod may extend, said tubular body portion having a height sufficient for the lower end portion of the rod received therein to equal several diameters of the rod thereby permitting a substantial vertical adjustment of the attaching means relative to the rod, a continuously threaded portion disposed at the upper end of the tubular body portion, and engaged with the rod extending therein at any point on the lower portion thereof which approximates the height of the tubular body portion, an ornamental flange extending laterally outwardly from said tubular body portion, underlying an adjacent lower surface of the panel and providing support therefor, and torquing surfaces engageable to rotate said attaching member and thereby provide a vertical adjustment for establishing a desired orientation of the display panel relative to the floor of the exhibition hall.

2. An overhead display panel installation as in claim 1, wherein the attaching means further comprise means for detachably mounting the attaching members on the display panel in rotatable relation thereto, and further wherein:

said torquing surfaces are formed on the threaded portion and disposed above the display panel.

3. An overhead display panel installation as in claim 2, wherein the detachable mounting means respectively comprise a washer telescoped over an upper end portion of the an attaching member, which projects above an upper surface of the display panel and a snap ring, engaging the tubular portion of the attaching member immediately above the washer.

4. An overhead display panel installation as in claim 3 wherein the attaching members are characterized in that each tube portion comprises a length of tubing, each threaded portion is a nut secured to the upper end of the length of tubing, and each nut has said torquing surfaces formed thereon, and said flange portion is provided by a disc, secured to the lower end of the length of tubing and closing off the lower end thereof.

* * * * *